US005488743A

United States Patent [19]

Alfonso

[11] Patent Number: 5,488,743

[45] Date of Patent: Feb. 6, 1996

[54] TOILET SEAT PEDAL LIFTER

[76] Inventor: Pedro J. Alfonso, P.O. Box 543, Felda, Fla. 33930

[21] Appl. No.: 389,215

[22] Filed: Feb. 15, 1995

[51] Int. Cl.[6] ..... A47K 13/10

[52] U.S. Cl. ..... 4/246.1; 4/246.3

[58] Field of Search ..... 4/246.1, 246.2, 4/246.3, 246.4, 246.5

[56] References Cited

U.S. PATENT DOCUMENTS

| | | | |
|---|---|---|---|
| 1,276,472 | 8/1918 | Zeen | 4/246.4 |
| 1,511,533 | 10/1924 | Staszak | 4/246.1 |
| 2,636,185 | 4/1953 | Boston | 4/246.1 |
| 2,723,400 | 11/1955 | Wilson | 4/246.1 |
| 3,493,974 | 2/1970 | Smith | 4/246.5 |
| 4,592,097 | 6/1986 | Zimmerman | 4/246.4 |
| 4,736,470 | 4/1988 | Classon | 4/246.4 |
| 4,807,307 | 2/1989 | Sato et al. | 4/246.4 |
| 5,056,165 | 10/1991 | Wescott, Sr. | 4/246.4 |

FOREIGN PATENT DOCUMENTS

| | | | |
|---|---|---|---|
| 257226 | 12/1912 | Germany | 4/246.3 |

*Primary Examiner*—Henry J. Recla

*Assistant Examiner*—Charles R. Eloshway

[57] ABSTRACT

A mechanical apparatus used to lift and lower the lid and seat of a toilet by way of a pedal mechanism. The pedal mechanism is connected by levers to a cylindrical lifting device mounted on a shaft. The lifting device is connected to the lid and seat by clasps which are screwed, bolted, riveted, or glued to the toilet lid and seat. The apparatus is held in place by floor braces attached by threaded studs which are fixed to the floor by nuts or by being cemented in depending on the material to be fixed to. An adjusting lever proceeding from the lifting device and connected to the pedal mechanism by a lever, can be adjusted so that the lid and seat stay up after taking the foot away from the pedal. One or both pedals can be actioned at the same time with one foot. The pedal stirrups are cup shaped. Thus the lid and seat can be lifted by pressing down with the sole of the shoe. To lower the seat and/or lid, the top of the shoe toe makes contact with the inside top of the pedal stirrup pressing upwards on the pedal thus lowering the seat and/or the lid. The entire apparatus can be made of synthetic materials and/or noncorrosive metal with the exception of the mounting shaft and the floor braces. For the mounting shaft and the floor braces noncorrosive metal is best due to the strain produced when fixing the apparatus in its place to keep it secured.

1 Claim, 4 Drawing Sheets

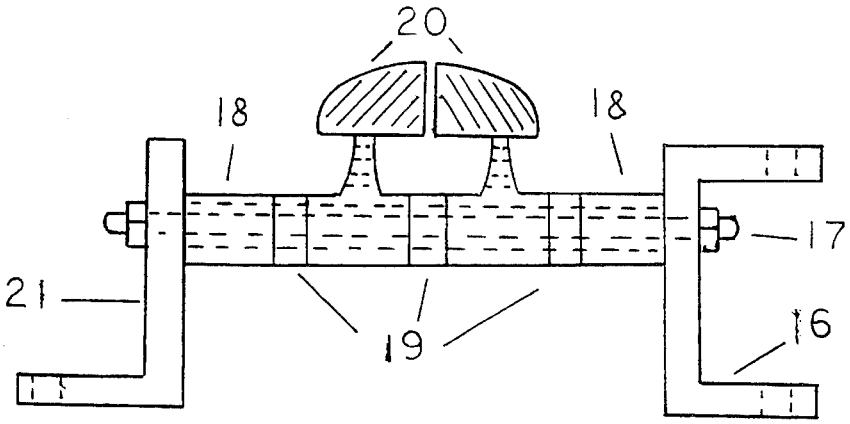
FIG. 4
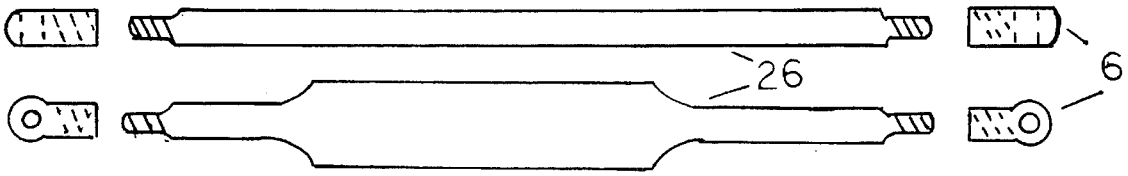
FIG. 5
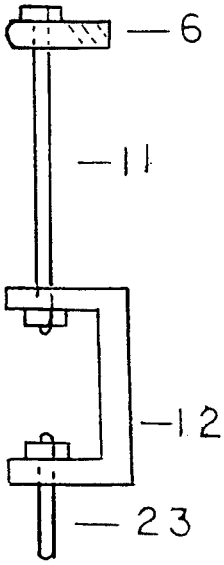
FIG. 7
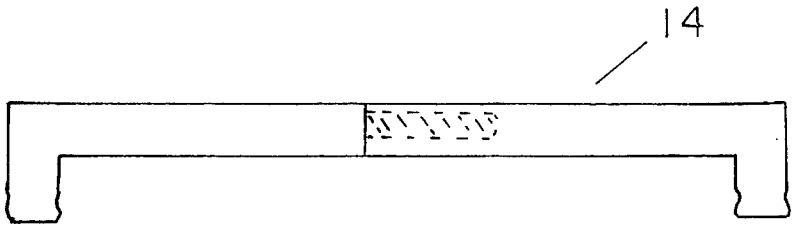
FIG. 6
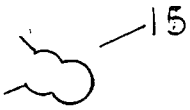

TOILET SEAT PEDAL LIFTER

This improved original apparatus for raising and lowering the toilet lid and seat by means of a pedal mechanism is a novelty over prior art in that the pedals are cup shaped so that the foot can be inserted to operate the pedals up or down. The pedals have a hollow cylindrical base so as to rotate mounted on a rod when the pedals are depressed or raised together or independently.

Another improvement over prior art is the hollow cylindrical lifting device used to lift and lower the lid and seat. This lifting device is mounted on a shaft which serves as its axis for rotating. The shaft is part of the bracing mechanism used to secure the pedal mechanism and the cylindrical lifting device next to the toilet. The many adjustable points in the apparatus allow for the easy adaptation to all different toilet models.

BRIEF DESCRIPTION OF THE DRAWINGS

FIG. 4 is a front view of the pedal mechanism 13 with floor braces 16 and 21 of the Pedal Lifter of FIG. 1.

FIG. 5 is a front and top view of the mounting shaft 26 and threaded thimble 6 of the Toilet Seat Pedal Lifter of FIG. 1. The cylindrical lifting device 25, FIG. 3, rides on this mounting shaft 26.

FIG. 6 is a longitudinal view of one of two identical levers connecting the pedal shafts 22 to the adjusting levers 9 on the cylindrical lifting device 25.

FIG. 7 is a front view of the opposite floor brace attachment on the right side of the toilet.

DETAILED DESCRIPTION

Figure 1:
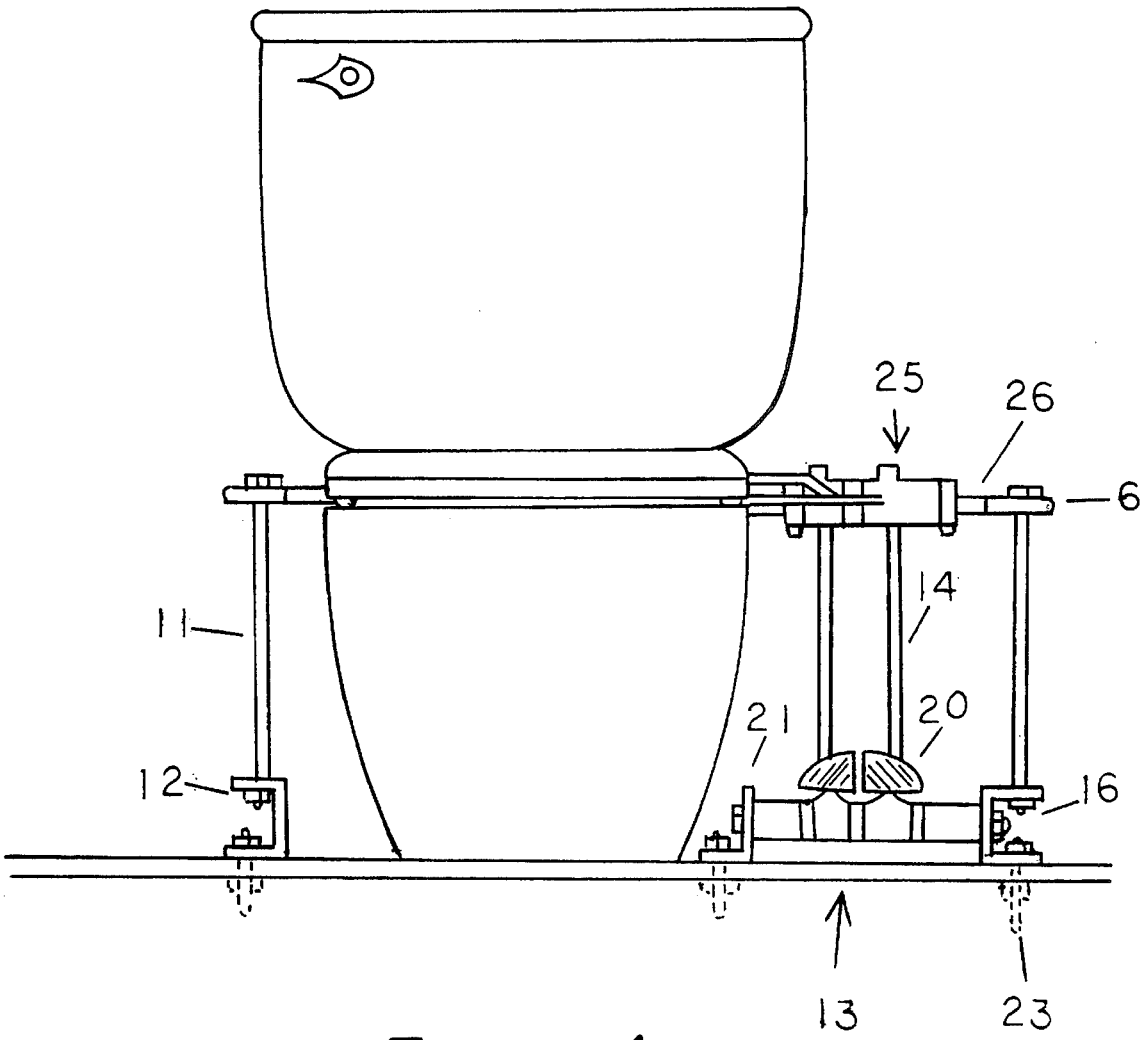
FIG. 1 is a frontal view of the Pedal Lifter seen attached to a toilet.

In FIG. 1 is a front view of a toilet set up with a Toilet Seat Pedal Lifter attached. In this case it is attached to a floor where floor braces 12, 16, and 21 can be attached with threaded studs 23, and nuts on both ends of the threaded studs 23. In case of a concrete floor, the studs 23 are cemented into the floor where the braces 12, 16, and 21 can be attached by nuts on top of studs 23. The elongated bolts 11 go through the eye of the threaded thimble 6 and down through the braces 12 and 16. The elongated bolts 11 are then tightened thus pressing down firmly the flat part of the mounting shaft 26 onto the back of the toilet bowl between the lid and seat toilet attachment and the water tank. The downward tension of the shaft 26 keeps the cylindrical lifting device 25 in a stable and secured position.

Figure 2:
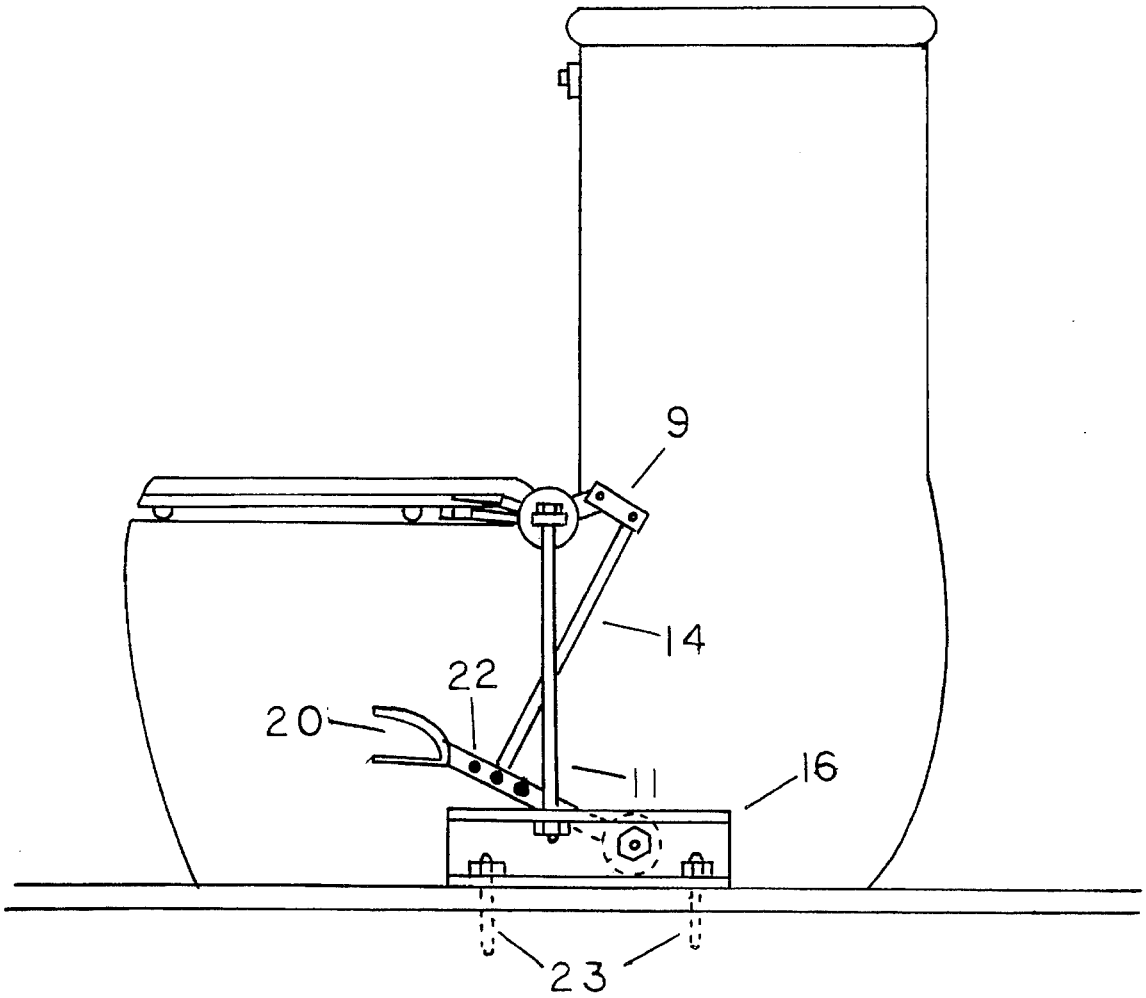
FIG. 2 is the left side view of the Pedal Lifter.
Figure 3:
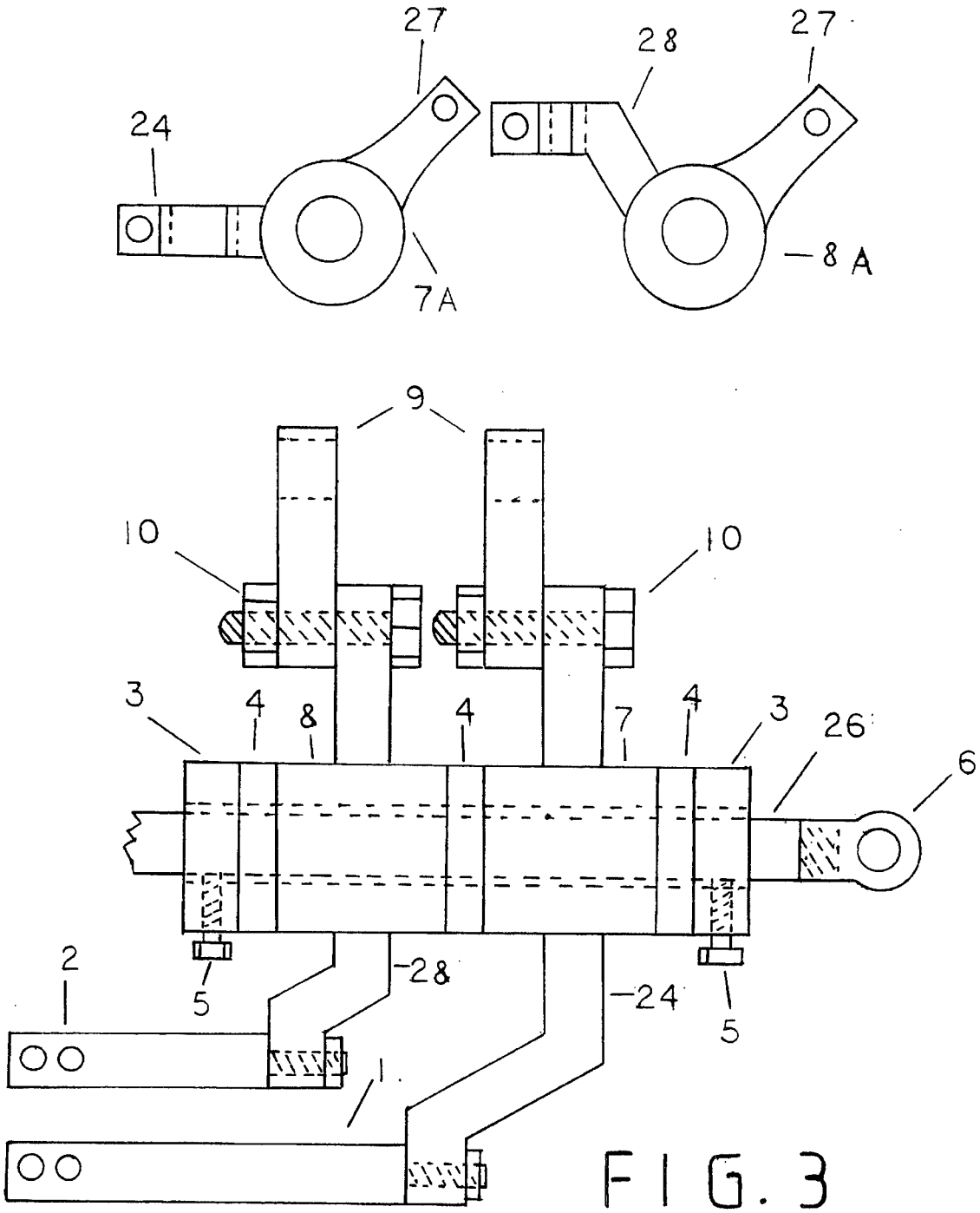
FIG. 3 is the top view of the cylindrical lifting and lowering device 25 of the Pedal Lifter of FIG. 1, with separate side views of the lifting cylinders 7 and 8, marked 7A and 8A.

FIG. 2 shows left side view of the invention. Left pedal stirrup 20 is seen showing an open cup shape, where the foot would be positioned to operate the pedal downwards or upwards. The pedal stirrup 20 the pedal stirrup 20 closest to the toilet, is in close proximity to the pedal stirrup farthest from the toilet. The pedal stirrups are in close proximity so that both lifting cylinders 7 and 8 can be actioned at the same time. This may be done by positioning the foot in the center where both stirrups are closest. FIG. 4 shows proximity of stirrups 20. Pressing down or lifting on the pedal stirrup 20 closest to the toilet actions only the lifting cylinder 8, and likewise the toilet lid upwards or downwards. Each pedal shaft 22 has several holes along the shaft positioned for the purpose of adjustment of the pedal lever 14. One end of the pedal levers 14 is attached through a hole at the pedal shaft 22 and held by retaining clip 15. The other end goes through a hole in the adjusting lever 9 and held in place by a retaining clip 15. Levers 14 have two parts each. At the center lever 14 has a male fitting threaded end screwed into a female threaded end. This way of adjoining the two sides provides for an adjusting to the needed length between the pedal shaft 22 holes and the hole in the adjusting lever 9. The unscrewing of the pedal lever 14 increases its length for the proper adjustment. Adjusting lever 9 is attached to connecting bar 27 by a bolt and nut 10. Levers 9 can be positioned at the required angle to the connecting bars 27 so as to give the best angle for lifting the toilet lid and seat. The adjustment is also made so that the lid and seat stay in the upwards position after removing the foot from the stirrups 20.

The cylindrical lifting device 25 rides on the shaft 26. Mounting shaft 26 has a threaded thimble 6 at each end which can be removed to allow the mounting of the lifting device 25. These threaded ends on shaft 26 may allow for its cutting to a shorter size when the space of the area requires it. If the shaft is cut to shorter size, the end is re-threaded. The lifting device has three friction washers 4. One between the lifting cylinders 7 and 8, and one on each side of the same. Holding in place the lifting cylinders 7 and 8, and the three friction washers 4, are two retaining washers 3. These two retaining washers 3 are on each end of the cylindrical lifting device 25, next to the friction washers 4. The retaining washers 3 have a compressing bolt 5 which can be screwed in to press onto the mounting shaft 26, thus holding the device in place. Lifting cylinder 8 has a clasp connecter 28 which is offset so as to be leveled with the toilet lid. The side view 8A of the lifting cylinder 8 can better illustrate the offsetting of the offset clasp connecter 28. Lifting cylinder 7 has a straight clasp connecter so as to be in line with the toilet seat. The side view 7A of the lifting cylinder 7 can better illustrate the straight position of clasp connecter 24. Cylinder 8 has lid clasp 2 connected to it, and cylinder 7 has seat clasp connected to it. Clasp 1 and 2 each have a threaded end which inserted into the hole on clasp connecter 24 and 28, are held in place by a nut. This permits the interchanging of longer or shorter clasps depending on the needed length. This way of attaching the clasps also allow for closer adjustment in as far as the level of the lid and seat in reference to the attaching clasp. Clasp 2 is shorter than clasp I since it is attached to the lifting cylinder closest to the toilet. Clasps 1 and 2 are attached to the toilet lid and seat by screws, bolts, rivets or glued depending on the material and designed of the toiled lid and seat.

The pedal mechanism 13, FIG. 4, has three friction washers 19. One friction washer 19 goes between the pedals and one on each side of the pedals, between the pedals and cylindrical spacer 18. It is all mounted together by using a threaded rod 17 that is threaded only at each end. It passes through the center of the parts. It is mounted on floor brace 16 and 21 and held by nuts at each end of the rod 17.

The floor brace 12 on the right side of the toilet, holds mounting shaft 26 in place on that side. An elongated bolt 11 passes through the eye of the threaded thimble 6 at that end of the shaft 26. The threaded end of bolt 11 is passed through the top hole of floor brace 12 and held in place by a nut. The securing of shaft 26 on the right side is illustrated in FIG. 7.

In operation as the foot is placed in the stirrup 20 and it is pressed down, the pedal shaft 22 is forced down thus pulling on the adjusting lever 9 by means of lever 14. As adjusting lever 9 is pulled downwards the lifting cylinder 7 or 8 respectively is rotated backwards upon mounting shaft 26. This backward rotation of the lifting cylinders raises upwards clasp connecters 24 or 28 depending upon which pedal is being pressed. As this takes place the lid or seat accordingly is raised. The cylindrical base of the pedal rides upon rod 17.

I claim:

1. A toilet seat and lid raising and lowering apparatus comprising:

a pedal mechanism including first and second cup-shaped, foot receiving stirrups connected by first and second pedal shafts to first and second cylinders, each said cylinder rotatably mounted on a support rod;

first and second floor braces, said support rod connected therebetween for mounting said pedal mechanism on a floor surface adjacent the toilet;

first and second levers connected at one end to said first and second pedal shafts, and connected at another end to first and second cylindrical lifting devices;

a mounting shaft forming an axis on which said cylindrical lifting devices are rotatably mounted, said shaft having threaded ends for receiving mating threaded eyes, said eyes extending beyond opposite edges of the toilet;

first and second clasp connectors connected at one end to said first and second cylindrical lifting devices and adapted to be connected at an opposite end to one of the toilet lid and toilet seat;

first and second elongated bolts, said first bolt passing through one of said threaded eyes and connected to said first floor brace, said second elongated bolt passing through the other of said eyes and connected to a third floor brace; whereby, said stirrups are selectively movable to lift and lower said toilet seat and lid.

* * * * *